US006917507B2

(12) United States Patent
McClintock et al.

(10) Patent No.: US 6,917,507 B2
(45) Date of Patent: Jul. 12, 2005

(54) STATIC NEUTRALIZING ROLL FOLLOWER

(75) Inventors: Scott R. McClintock, Kintnersville, PA (US); Michael F. Soffa, Trappe, PA (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/780,406

(22) Filed: Feb. 17, 2004

(65) Prior Publication Data

US 2004/0238906 A1 Dec. 2, 2004

Related U.S. Application Data

(60) Provisional application No. 60/475,096, filed on Jun. 2, 2003.

(51) Int. Cl.[7] ..... H05F 1/00
(52) U.S. Cl. ..... 361/214; 361/220
(58) Field of Search ..... 361/212, 214, 361/220, 221

(56) References Cited

U.S. PATENT DOCUMENTS

| | | | | | |
|---|---|---|---|---|---|
| 3,863,108 | A | * | 1/1975 | Blythe et al. | 361/212 |
| 4,322,156 | A | * | 3/1982 | Kohyama | 399/50 |
| 5,367,364 | A | * | 11/1994 | Michlin et al. | 399/176 |
| 5,420,743 | A | * | 5/1995 | Domes | 361/214 |
| 2004/0027778 | A1 | * | 2/2004 | Chase et al. | |

* cited by examiner

*Primary Examiner*—Ronald Leja
(74) *Attorney, Agent, or Firm*—Mark W. Croll; Paul F. Donovan

(57) ABSTRACT

A static neutralizing roll follower includes a static charge dissipating device on a carrier movably held by a support. Sensors follow the changing diameter of a roll, and a control unit processes signals from the sensor to operate a drive mechanism to move the carrier with respect to the changing roll diameter. Consistent spacing is maintained between the dissipating device and the roll surface.

20 Claims, 2 Drawing Sheets

STATIC NEUTRALIZING ROLL FOLLOWER

CROSS-REFERENCE TO RELATED APPLICATIONS

The present application claims the benefits of U.S. Provisional Application Ser. No. 60/475,096, filed on Jun. 2, 2003.

FIELD OF THE INVENTION

The present invention relates to static control devices; and, more particularly, the invention relates to static control devices used in web handling processes in which rolls of a web are wound or unwound.

BACKGROUND OF THE INVENTION

A variety of processes involve the use of webs that are wound, unwound and/or rewound during the performance of the process. Movement of the web through apparatus performing the process can have frictional contact between the web and rotating members or stationary members and guide devices across which the web is directed. Consequently, the web can accumulate both positive and negative static charges. Some webs such as, for example, paper webs accept and hold static charges readily. Build up of static charges in the web can impact equipment or process performance and functionality. Charges in the web can cause the web to be attracted to or repelled from transport surfaces, interfering with proper transport and direction of the web through the process equipment.

Electrostatic charges can present significant hazards to operator safety, product quality and electronic process control. If the charge level on the roll or web reaches a critical limit, a spark can occur, arcing to conductive things that are near by. Damage can occur to critical electronic components, and personnel in proximity can be injured. Even apart from the potential danger to individuals, the danger and damage to equipment can be significant and costly to repair.

In some converting operations, a large parent roll of the web is unwound, processed and rewound into another roll or rolls. For example, a simple slitting operation may be performed to divide a wide web into a plurality of narrower webs. Plastic films, coated paper and other materials rewound in such slitting and rewinding converting operations can become large capacitors, capable of storing in excess of 50,000 volts of static electricity. These highly charged capacitors can discharge, causing shocks to operators potentially resulting in burns or subsequent injuries due to the physical reaction from receiving an electrical shock. Rapid discharge in the nature of arcing to nearby conductors can producing a strong arc several inches long, causing a potential fire or explosion hazard under some conditions. For example, the paper dust present from a slitting operation potentially can be explosive.

Build-up of static charges also can cause damage to the web. If the electrostatic charge is sufficiently high, a spontaneous discharge in the form of sparks can occur. Products with coated surfaces, such as silicone release liners, are easily damaged by such sparks, which can result in significant product scrap rates. Highly cosmetic materials may develop visible streaking when damaged by spontaneous discharge sparks, referred to as "static trees", also resulting in lost production yield.

The web also can become contaminated as the result of building static electric charges. Statically charged objects, such as wound rolls, will attract and retain contamination such as slitter dust, atmospheric contaminants and debris or chips from machining. Such contamination wound into a roll damages not only the immediate area contacted by the contaminant, but also can damage layers in the roll above and below the contaminant by puckering, wrinkling or other layer distortion.

Further, static discharges and the associated electromagnetic interference can damage sensitive electronic equipment, causing loss of data memory and the generation of false signals. Static discharges also can cause programmable logic controllers, computers and other electronic control devices to lock-up or freeze while equipment is operating.

Difficulties have been encountered in designing and applying static charge neutralizing devices on equipment in which a web is wound or unwound in a roll. The changing diameter of the roll has made it difficult and/or costly to effectively neutralize static charges accumulating therein.

Several devices have been used, with differing degrees of success. High output static neutralizing equipment has been mounted in fixed positions relative to the building or unwinding roll, to work over the continuous changing distance as the roll diameter changes. Such devices have become less effective as the distance between the outside surface of the roll and the static neutralizing equipment increases.

In another known design, a rider roll is used in direct contact with the material winding on or unwinding from the supply roll. The rider roll rides the top of the outer surface as the diameter of the supply roll changes. Static neutralizing equipment is mounted on the rider roll support arms so that it maintains an appropriate working distance from the web roll outer surface as the diameter changes. Uses of such devices are limited to material and processes that can tolerate direct contact of the rider roll on the roll of material.

It is known also to use ionizing blowers in fixed locations to propel a stream of ionized air over a continuously changing distance as the roll diameter changes. These devices have been limited to slower web speeds, generally no greater than 300 to 500 feet per minute, and become less effective as the distance increases between the outside surface of the roll and the ionizing air blower.

What is needed in the art is a static neutralizing device that effectively follows the moving surface of a building or unwinding roll, to effectively neutralize static charges even as the roll diameter changes.

SUMMARY OF THE INVENTION

The present invention meets the aforementioned need by providing a static charge dissipating device that is movable secured in a frame and moved by a drive mechanism in response to a control unit and sensor monitoring the changing location of the surface of a roll.

In one aspect thereof, the present invention provides a static charge neutralizing assembly for a surface having a changing position. The assembly has a carrier and a static charge dissipating device carried by the carrier. A drive mechanism is connected to the carrier for moving a position of the carrier and thereby a position of the dissipating device. A sensor detects a changing position of the surface and provides a signal indicative thereof. A control unit is connected to the sensor and to the drive mechanism to active the drive mechanism in response to signals received from the sensor.

In another aspect thereof, the present invention provides a static charge neutralizing assembly for a web roll that changes in diameter. The assembly has a stationary support and a carrier moveably held by the support. A static charge dissipating device is on the carrier. A drive mechanism is provided for moving the carrier. A sensor and control system senses the roll diameter and operates the drive mechanism in response to roll diameter changes.

In still another aspect thereof, the present invention provides a method for dissipating static electric charges on a rotating roll having a web wound thereon. The method includes rotating the roll, positioning a static charge dissipating device adjacent a surface of the roll, detecting changes in diameter of the roll and moving the static charge dissipating device in response to detected changes in the diameter of the roll.

An advantage of the present invention is providing a static charge neutralizing device that moves in response to the changing diameter of a roll.

Another advantage of the present invention is providing an effective static charge neutralizing device that functions spaced from the surface of a web roll to neutralize static charges without contacting the web.

A further advantage of the present invention is providing a static charge neutralizing device that works effectively on full rolls and on empty rolls, and works effectively on fast web speeds as well as slow.

Other features and advantages of the invention will become apparent to those skilled in the art upon review of the following detailed description, claims and drawings in which like numerals are used to designate like features.

Figure 1:
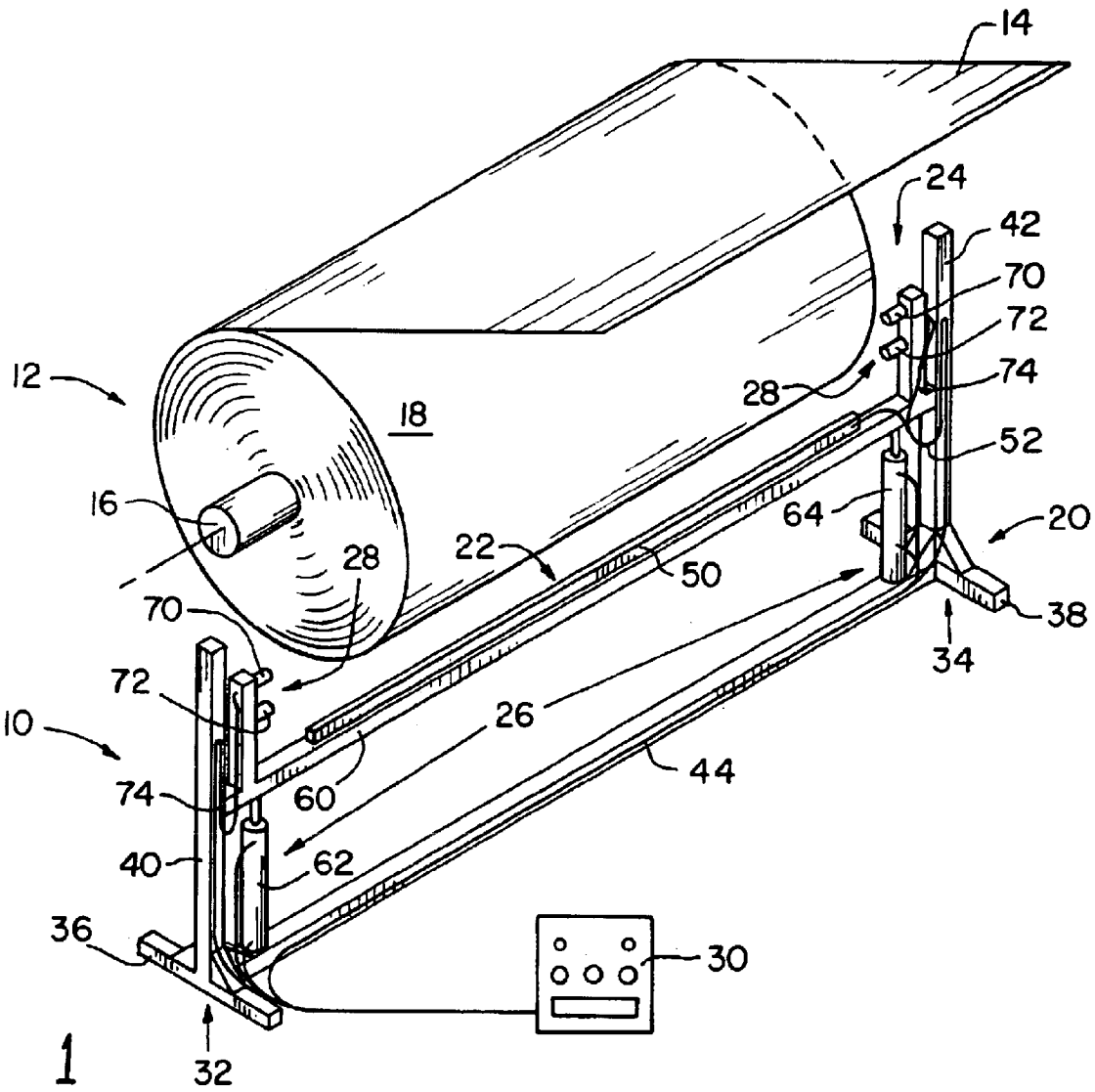
FIG. 1 is a perspective view of a static neutralizing roll follower in accordance with the present invention, shown in position for operation with a large diameter roll.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use herein of "including", "comprising" and variations thereof is meant to encompass the items listed thereafter and equivalents thereof, as well as additional items and equivalents thereof.

DETAILED DESCRIPTION OF THE PREFERRED EMBODIMENT

Referring now to the drawings, and more specifically to FIG. 1, there is shown a static neutralizing roll follower assembly 10 in accordance with the present invention. Assembly 10 is positioned for operation with respect to a wound roll 12 including a web 14 on a roll core or mandrel 16. Assembly 10 can be used with a wide variety of rolls 12, including rolls 12 of different sizes and rolls 12 having webs 14 of different materials. For example, web 14 can be a paper web, a film or other material. Further, assembly 10 can be used in conjunction with a building roll 12, that is a roll 12 on which web 14 is being wound; or assembly 10 can be used with respect to an unwinding roll 12 from which web 14 is being removed. Assembly 10 works equally well with a roll 12 that is increasing in diameter or with a roll 12 that is decreasing in diameter as the process proceeds.

Assembly 10 is provided to operate with respect to an outer surface 18 of roll 12. Assembly 10 includes a support structure 20, and a static charge dissipating device 22 on a carrier 24 moveable held in support 20. A drive mechanism 26 is provided between support 20 and carrier 24. A sensor control system includes a sensor 28 operatively connected to a control unit 30 for controlling operation of drive mechanism 26 and thereby the position of carrier 24 with respect to support 20.

In the embodiment shown, support 20 includes first and second upright standards 32 and 34, each having a base 36, 38, respectively, and an upright 40, 42, respectively, provided at opposite ends of roll 12. A cross member 44 interconnects standards 32 and 34 at bases 36 and 38. Support 20 as described works well for retrofitting an assembly 10 in an existing process where sufficient space is available beneath roll 12 used in the process. However, it should be realized that support 20 can take a variety of shapes and configurations. For example, existing framework of apparatus within a process can be used to support a static charge dissipating device 22. Also, support 20 for dissipating device 22 can be variously located at positions about the periphery of roll 12. Thus, support 20 can be provided in such a way and location to position dissipating device 22 below roll 12 as shown, above roll 12 or at a lateral positions with respect thereto.

Static charge dissipating device 22 preferably is an ionizing device or other such structure that it can operate to dissipate static charge on roll 12 without being in physical contact therewith. For example, dissipating device 22 can include a plurality of bundles of brush-like fibers or filaments in which each filament is a fine, hair-like structure of carbon fiber, stainless steel fiber, conductive acrylic fiber or other conductive fiber type filament that can be provided in diameters sufficient small to induce ionization when in the presence of an electrical field. Rather than discrete bundles, such filaments can be provided in a relatively continuous pattern.

Device 22 further includes a conductive body 50 electrically connected to a conductor 52, such as a wire or other conductor, by which conductive body 50 is electrically connected to a grounding circuit. Those skilled in the art will understand readily dissipating device 22 can include other types of static charge neutralizing devices that operate to discharge static charges from roll 12 while in spaced relation to surface 18. By way of further example, conductive body 50 can be an emitter for ionized air.

Figure 2:
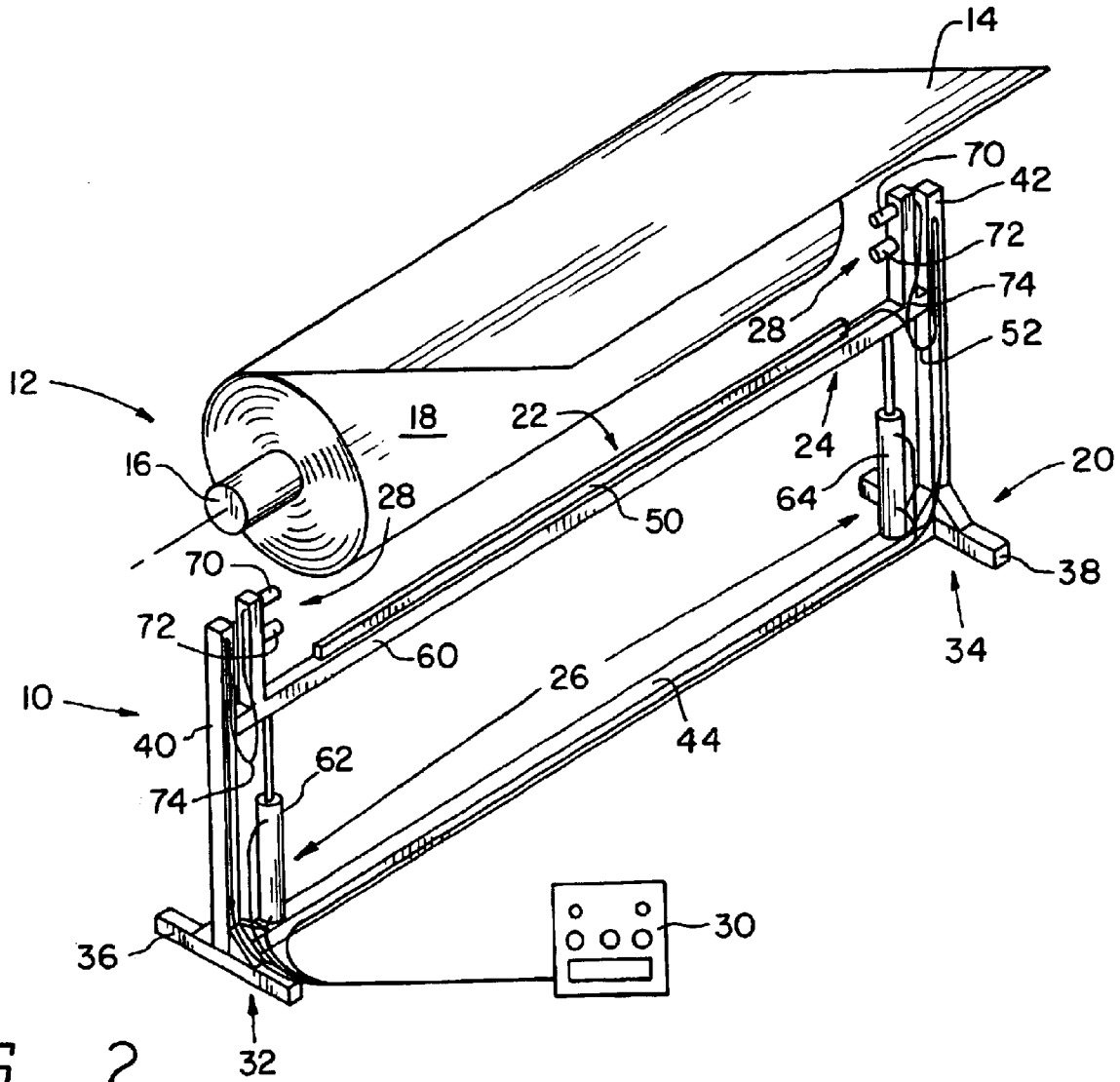
FIG. 2 is a perspective view of a static neutralizing roll follower in accordance with the present invention positioned for operation on a smaller roll.

Carrier 24 is in the nature of a cross member 60 between uprights 40 and 42, and holds thereon static charge dissipating device 22. Cross member 60 is slidingly held relative to uprights 40 and 42 to move between a lower-most position relative to the largest diameter roll 12 that may be provided (FIG. 1), and uppermost position at which an end of web 14 is reached and roll 12 is at a minimal diameter. FIG. 2 illustrates an intermediate position between the full roll position shown in FIG. 1 and a web end position (not shown) either at the start of winding web 14 on roll 12, or when the end of web 12 is removed from core 16 in an unwind operation. Those skilled in the art will understand readily structures by which cross member 60 can be held slidingly by uprights 40 and 42. For example, a sliding bracket around the uprights can be connected to cross member 60, a channel or slot in uprights 40 and 42 can slidingly receive shaped ends of cross member 60, and the like.

Drive mechanism 26 includes at least one actuator 62, 64 for moving cross member 60 relative to support 20. In the exemplary embodiment, two actuators 62, 64 are shown at opposite ends of cross member 60, and actuators 62, 64 are shown as hydraulic cylinders. It should be readily understood that other types of actuators 62, 64 also can be used. In some uses of the invention, such as for a small roll 12, a single actuator may be sufficient. In other uses of the invention, such as for large rolls 12, more than two actuators can be used. Hydraulic cylinder actuators 62 and 64 work well between support cross member 34 and carrier cross member 60, but other types of actuators also can be used. For example, screw type actuators, pneumatic cylinders, gear drives and pulley systems also can be used.

Sensor 28 is affixed to carrier 24 for movement therewith and includes one or more photoelectric or other proximity sensors 70, 72, two such proximity sensors 70, 72 being shown. Sensors 70, 72 are provided to detect the edge of roll 12, thereby providing a data signal indication of the location of surface 18.

Control unit 30 is connected to sensor 28 via a signal conductor or conductors 74, for receiving data signals therefrom. Control unit 30 is adapted to process such data signals from sensor 28, and to provide operating control signals for the operation of actuators 62 and 64 for altering a condition thereof and thereby moving carrier 24 with respect to support 20. In that way, an appropriate and consistent working distance is maintained between surface 18 and static charge dissipating device 22.

In the use of the present invention, as the diameter of roll 12 changes, either because of the removal of lengths of web 14 from roll 12 or from the winding up of web 14 on core 16, sensors 70, 72 detect and follow the changing position of surface 18. Control unit 30 receives and processes data signals from sensors 70 and 72, and provides control signals for the operation of actuators 62 and 64. Carrier 24 is moved with respect to the changing diameter of roll 12, and dissipating device 22 remains in a preferred position with respect to surface 18, even as the location of surface 18 changes. Thus, the present invention works equally well for rolls in which the diameter of roll 12 is increasing and for rolls for which the diameter of roll 12 is decreasing, from the start to the end thereof.

The present invention works well to maintain consistent spacing for dissipating devices 22 of various types, including both contacting and non-contacting devices. The adjustment in position of carrier 24 is rapid, responding in real time to roll diameter changes. The assembly works well, regardless of the speed of web 14 or the rotating speed of roll 12.

While the present invention has particular advantage when provided with dissipating devices 22 that operate in spaced relation to roll surface 18, it also provides advantages for use with contacting type dissipating devices. As compared with the known ionizing type devices, the present invention maintains a continuous fixed spacing between dissipating device 22 and roll 12 so that the performance of dissipating device 22 is maintained as the diameter of roll 12 changes. With a contacting type dissipating device 22, the present invention allows for gentle contact between dissipating device 22 and surface 18 of roll 12, with much less resistance as compared with rider roll type static charge neutralizing devices. However, most advantageously, the present invention works well with dissipating devices that can be held in spaced relation to roll 12, while continuing to perform effective, controlled static charge dissipation.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

What is claimed is:

1. A static charge neutralizing assembly for a surface having a changing position, said assembly comprising:

a carrier;

a static charge dissipating device carried by said carrier;

a drive mechanism connected to said carrier for moving a position of said carrier and thereby a position of said dissipating device;

a sensor for detecting a changing position of the surface and for providing a signal indicative thereof; and a control unit connected to said sensor and to said drive mechanism to active said drive mechanism in response to signals received from said sensor.

2. The assembly of claim 1, said static charge dissipating device being spaced from the surface.

3. The assembly of claim 2, said drive mechanism including a hydraulic cylinder.

4. The assembly of claim 2, said drive mechanism including two hydraulic cylinders.

5. The assembly of claim 4, said sensor being a photoelectric sensor.

6. The assembly of claim 5, said carrier being movably held in a support.

7. The assembly of claim 1, said drive mechanism including a pneumatic cylinder.

8. The assembly of claim 1, said sensor being a photoelectric sensor.

9. The assembly of claim 1, said carrier being movably held in a support.

10. A static charge neutralizing assembly for a web roll changing in diameter, said assembly comprising:

a stationary support;

a carrier moveably held by said support;

a static charge dissipating device on said carrier;

a drive mechanism for moving said carrier; and a sensor and control system for sensing the roll diameter and operating said drive mechanism in response to roll diameter changes.

11. The assembly of claim 10, said static charge dissipating device being held by said carrier in spaced relation to the roll.

12. The assembly of claim 10, said drive mechanism including a pneumatic cylinder.

13. The assembly of claim 10, said drive mechanism including two pneumatic cylinders.

14. The assembly of claim 13, said static charge dissipating device being held by said carrier in spaced relation to the roll.

15. The assembly of claim 10, including a proximity sensor on said carrier adapted for detecting a surface of the roll.

16. The assembly of claim 15, said sensor being a photoelectric sensor.

17. The assembly of claim 10, said support including standards at ends of the roll and a cross member between said standards.

18. The assembly of claim 17, said carrier being held between said standards, and said drive mechanism including at least one actuator operatively connected between said cross member and said carrier.

19. A method for dissipating static electric charges on a rotating roll having a web wound thereon, said method including steps of:

positioning a static charge dissipating device adjacent a surface of the roll;

detecting changes in diameter of the roll; and moving the static charge dissipating device in response to detected changes in the diameter of the roll.

20. The method of claim 19, including maintaining a spaced relation between the surface of the roll and the static charge dissipating device.

* * * * *